United States Patent [19]

Lerner et al.

[11] Patent Number: 4,657,253

[45] Date of Patent: Apr. 14, 1987

[54] TOY BALL WITH TAIL

[76] Inventors: Christopher Lerner, 2801 Quebec St., NW., Apt. #145, Washington, D.C. 20008; Brian S. Kressin, 1704 Hampshire Green La., Apt. #22, Silver Spring, Md. 20903

[21] Appl. No.: 780,952

[22] Filed: Sep. 27, 1985

[51] Int. Cl.[4] ..... A63B 43/02

[52] U.S. Cl. ..... 273/58 A; 273/58 C; 273/58 K; 273/414; 273/428

[58] Field of Search ..... 273/58 C, 58 R, 58 A, 273/58 K, 199 A, 200 R, 413, 414, 428, 420

[56] References Cited

U.S. PATENT DOCUMENTS

| | | | |
|---|---|---|---|
| 801,145 | 10/1905 | Feltner | 273/58 C |
| 1,502,058 | 7/1924 | Quin | 273/58 C |
| 2,747,873 | 5/1956 | Carroad | 273/58 C X |
| 3,393,911 | 7/1968 | Lawson | 273/420 X |
| 3,588,104 | 6/1971 | Griffin | 273/58 C X |
| 3,729,194 | 4/1973 | Barnett | 273/58 C X |
| 3,862,757 | 1/1975 | Craig, II | 273/58 C |
| 4,088,319 | 5/1978 | Clarke | 273/58 K X |
| 4,127,268 | 11/1978 | Lindgren | 273/58 C |
| 4,200,288 | 4/1980 | di Donato | 273/58 K X |
| 4,294,447 | 10/1981 | Clark | 273/428 X |

*Primary Examiner*—Paul E. Shapiro

*Attorney, Agent, or Firm*—Mark G. Mortenson

[57] ABSTRACT

The invention relates to a rubber-like ball having an elastic fabric attached thereto. The ball is thrown by grasping the elastic fabric at a point distant from the ball and swinging the ball in a circular motion by the elastic fabric and subsequently releasing the elastic fabric resulting in the ball and the elastic fabric becoming a catchable projectile. The elastic fabric is fixed to the ball by inserting the same into a hole in the ball such that the fabric assumes a U-shape therein, wherein a bottom of the "U" is substantially flush with an outer forward surface of the ball.

14 Claims, 5 Drawing Figures

TOY BALL WITH TAIL

FIELD OF THE INVENTION

The present invention relates to a toy ball having an elastic fabric attached thereto. The ball is thrown by grasping the elastic fabric at a point distant from the ball and swinging the ball in a circular motion by the elastic fabric and subsequently releasing the elastic fabric resulting in the ball and elastic fabric becoming a projectile, which is to be caught.

BACKGROUND OF THE INVENTION

Since the beginning of time, man has amused himself by inventing various projectiles which are to used in some type of throw-and-catch manner. The simplest of such objects is the ordinary ball. The ball has taken on many different sizes and can be made from many different materials. Examples of more complex projectiles are the flying disc (i.e. Frisbee$^R$) and the boomerang. Each of these projectiles involves some requisite skill for both throwing and catching.

When a ball such as a baseball is to be thrown, the thrower must have an arm strong enough and accurate enough to throw the ball to a specific point. Similarly, a receiver or catcher must have the skill to catch the baseball. It is often necessary for a catcher to use an aid, such as a glove, to catch the ball. While many individuals posess the talent to enjoy a throw-and-catch game using a baseball—like object, many other individuals do not. For example, some individuals do not have a strong enough arm to throw a ball a sufficient distance with sufficient accuracy to recognize enjoyment. Likewise, some individuals have difficulty in catching a baseball - like object. Such individuals can soon become frustrated in their inability to throw and catch the ball. Still further, this frustration is enhanced when the ball continuously rolls away from the intended catcher.

The present invention has been developed to provide an alternate projectile which is easy to throw great distances and is easy to catch without using any type of catching aid, such as a glove.

SUMMARY OF THE INVENTION

The present invention has been developed in view of the foregoing and to overcome the above-discussed drawbacks. It is accordingly an object of the invention to provide a ball which is easy to throw and easy to catch by the average individual. More particularly, a ball is provided with a flexible tail member attached thereto, such that a thrower can spin the ball in a circular motion by grasping the tail, and a catcher can catch the ball by grabbing the tail of the ball as the ball passes by the catcher. Moreover, the ball does not roll or bounce a great distance from the catcher when the catcher misses the tail of the ball, or when the thrower makes an inaccurate throw.

BRIEF DESCRIPTION OF THE DRAWINGS

The following drawings are proivded to assist in understanding the invention, but are not intended to limit the scope thereof. Similar reference numerals have been used wherever possible in each of the figures to denote like components, wherein:

FIG. 3(*b*) is a view of the ball after the hook 5 has been pulled completely through the bore 6.

DETAILED DESCRIPTION OF PREFERRED EMBODIMENTS

Figure 1:
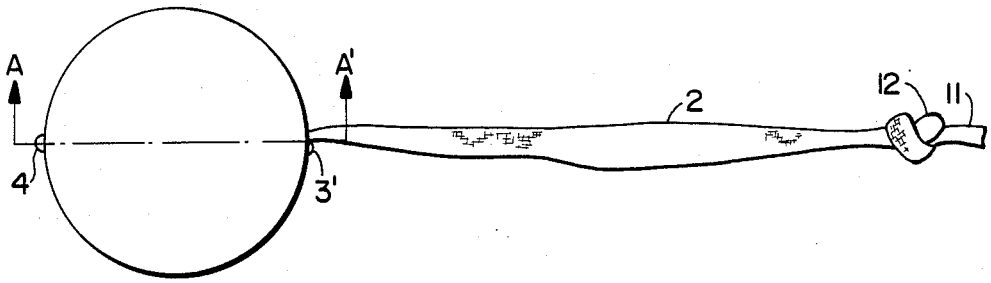
FIG. 1 is a side view of the toy ball with tail.

The ball with tail toy is shown generally in FIG. 1. The two major components of the ball with tail toy are the elastomer ball 1 and the elastic fabric tail 2. The ball can be made of any suitable elastomer which provides for an elastic collision when it impacts with a hard surface. Examples of acceptable materials are rubber, sponge rubber or silicone. The tail 2 can be made of any suitable material having elastic properties. Examples of acceptable materials for the tail include Spandex$^R$, nylon, Spandex$^R$/ nylon blend and other fabric material which will stretch to at least 1.25 times its normal size. The preferred material for the tail 2 is an elastic stocking-like (or hosiery-like) material which will stretch to between 150 and 200 percent of its normal length. The importance of selecting proper materials for the ball 1 and the tail 2 become more apparent upon examining the intended use of the ball with tail toy depicted in FIG. 4.

Figure 4:
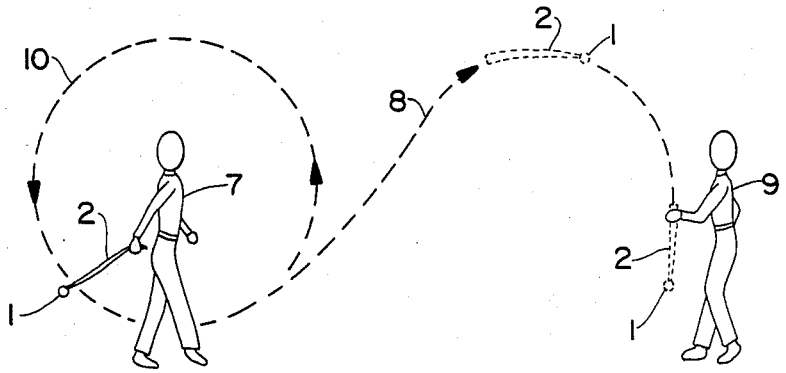
FIG. 4 is a perspective view of the intended use of the ball with tail.

FIG. 4 shows a thrower 7 spinning the ball 1 in a circular path 10 by holding the tail 2 near an end 11 which is distant from the ball 1. To facilitate grasping of the tail, a knot 12 can be provided thereon. The spinning ball develops a centrifugal force which increases as the ball is spun faster. This centrifugal force can be harnessed by the thrower 7. More particularly, the thrower 7 can release the tail 2 at a proper moment such that the centrifugal force of the spinning ball is released and causes the ball with tail to become a projectile which follows the path 8. Of course, the path 8 comprises an infinite number of possibilities depending upon how fast the ball 1 is spun and when the thrower 7 releases the tail 2. A catcher 9 then catches the ball 1 by grasping the tail 2 as the ball 1 passes by. The catcher 9 can of course also simply grab the ball 1 instead of the tail 2 providing that the ball 1 comprises a soft rubber material. However, it is preferable to grasp the elastic tail 2 because it is much longer than the ball 1 and therefore much easier to catch.

The tail 2 serves several additional important functions. Firstly, the elastic tail 2 serves as an impact cushioner (i.e. the ball 1 gradually stops when the elastic tail 2 is caught as opposed to abruptly stopping when the ball 1 is caught directly). Thus, a catcher 9 will not experience any physical discomfort in the hand area when the tail 2 is caught in flight. Also because of the elasticity of the tail 2 a catcher 9 can easily begin spinning the toy in a circular path 10 in preparation for a subsequent throw or can, with practice, catch and throw the toy in one contiguous motion. Secondly, the tail 2 will flap in the air when subjected to the flight path 8. The amount that the tail flaps is important. There must be sufficient flap to slow the toy along its flight path 8. More particularly, at the instant the thrower 7 releases the tail 2, the ball 1 has significant centrifugal force which is immediately changed to kinetic motion. It would be extremely difficult for a catcher 9 to catch the toy having such excessive kinetic motion. However, the flapping of the tail 2 along the flight path 8 results in friction between the air and the tail 2, thus slowing the toy to an acceptable speed for the catcher 9 to catch it. Friction between the air and the tail 2 will also cause the toy to return to the thrower if thrown high into a substantial wind.

It is important that the tail 2 is not too long or too wide which would cause excessive air friction. Experimentation has evidenced that when an elastomer rubber ball 1 having a diameter of 2½ inches and a weight of approximately ½ oz is used, the tail should have a width of not greater than 2 times the diameter of the ball 1, and a length not greater than 26 inches.

Thirdly, the elasticity of the tail 2 facilitates throwing the toy. This is because the expansive forces built up in the tail 2 as said tail 2 resists the centrifugal force created by a thrower 7 spinning the toy along a circular path 10, are, immediately prior to release of the toy along flight path 8, changed into kinetic energy and are added to the kinetic energy produced by said centrifugal force. Thus, the toy is easy to throw because of the ease of producing centrigufal force by swinging the toy in a circular path 10 and because of the added kinetic energy provided by the elasticity of the tail 2.

In addition to the tail 2 facilitating a thrower 7 throwing and a catcher 9 catching the ball, the tail 2 also prevents the toy from rolling away from a catcher 9, when a thrower 7 makes an errant throw. More specifically, when a catcher 9 cannot grab the tail 2, the toy will impact with the ground. A typical ball would simply bounce or roll away from the catcher 9. However, the tail 2 ameliorates this inconvenience. As will be discussed in greater detail hereafter, the tail 2 is located within a diametrical core in the ball 1. Hence, when the ball 1 impacts with the ground, the tail typically engulfs the ball 1, because the ball 1 rolls up in the tail 2 in a snowball-like effect. Alternately, the tail 2 will twist and tangle resulting in substantial friction with the ground. In any event, the tail significantly impairs the toy from rolling away from the catcher 9.

Figure 2:
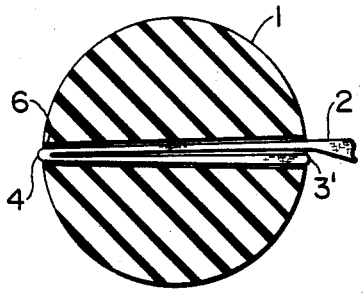
FIG. 2 is a cross-sectional view taken along the line A—A′ in FIG. 1.
Figure 3:
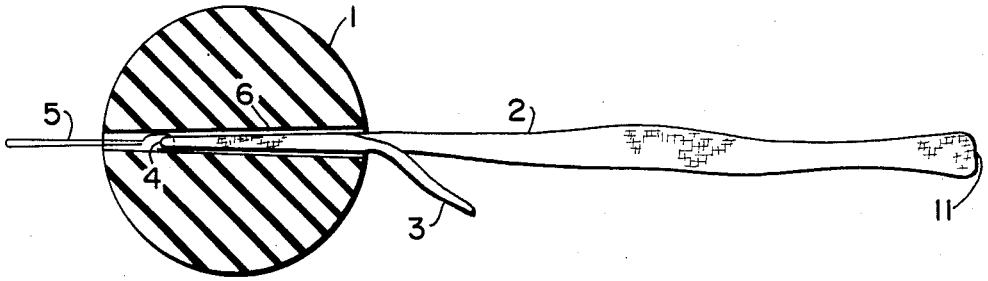
FIG. 3(*a*) is a view of the ball during insertion of the tail in the bore.
Figure 3B:
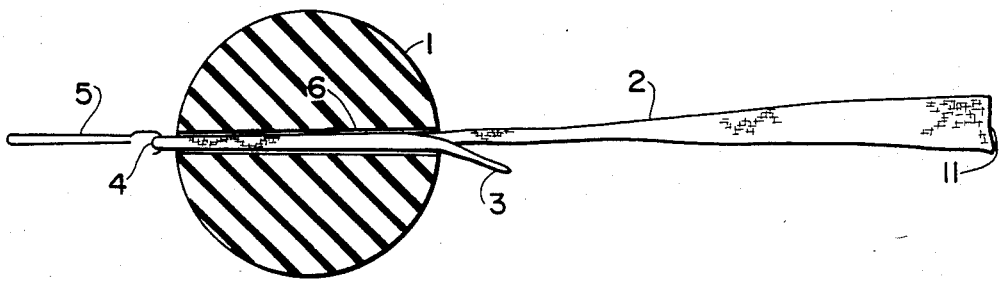

The final important feature of the tail 2 relates to the frictional interface which exists between the ball 1 and the tail 2. The preferred method of assembling the ball 1 and the tail 2 together is shown in FIGS. 3(*a*) and 3(*b*), and the resultant assembly is shown in cross section in FIG. 2.

Firstly, a hole 6 must be made through the ball 1. The hole 6 is preferably a diametrical hole. A preferable diameter of the hole is 1/16 inch. A bent wire or needle 5 is then placed in the hole 6 with the bent or holed end trailing. A portion of the tail 2 adjacent a first end 3 is then placed into the bent end of the needle 5 such that a portion of the tail 2 becomes "U-shaped" near the first end 3. The needle 5 is then pulled through the hole 6 bringing the "U-shaped" portion of the tail 2 into the hole 6, as shown in FIG. 3(*a*). The needle 5 is subsequently drawn completely through the ball 1 until a bottom portion 4 of the "U-shaped" tail protrudes from the ball 1, thereby permitting the needle 5 to be removed. The end portion 11 of the tail 2 is then pulled in a direction opposite to its insertion direction such that the end portion 4 a substantially flush with a forward outer surface of the ball 1. Any portion 3 which protrudes from the ball 1 is subsequently trimmed down to a portion 3; as shown in FIG. 2, resulting in the end 3; being substantially flush with a rearward outer surface of the ball 1. (The reference to forward outer surface means that surface of the ball 1 which leads the toy in normal flight, while the reference to rearward outer surface means that surface of the ball which faces opposite to the traveling direction, i.e., that surface which is closest to the end 11 of the tail 2.) Experimentation has proven that when the above-specified tail 2 is inserted into the hole 6 of the ball 1, the mechanical interlock (i.e. frictional interface) between the rough surface of the tail 2 and the inner surface of the hole 6 is adequate for any forseeable amount of centrifugal force which results when a thrower 7 spins the ball 1 in the circular path 10, as shown in FIG. 4. The strength of this frictional interface is attributable to the compression of the inside walls of the hole 6 and the sides of the "U-shaped" portion of the tail 2, said compression being achieved when the "U-shaped" portion of the tail 2 is pulled forcibly through the hole 6. Said compression also creates friction between the two sides of the "U-shaped" portion of the tail 2. Additionally, as the centrifugal force, created by swinging the toy along a circular path 10, is resisted by the end portion 11 of the tail 2, said end portion 11 will elongate. This elongation tends to reduce the friction between said end portion 11 and the inner walls of hole 6. However, this reduction in friction is ameliorated by the presence in said hole 6 of the end portion 3. This is because said end portion 3, which is in a compressed state because it was forced into hole 6, will expand somewhat as the end portion 11 elongates. Thus an adequate frictional interface is maintained between the inner walls of the hole 6 and the tail 2 generally. Accordingly, a very simple and inexpensive method for assembling the toy is available.

Various other configurations and assembly methods for the toy have also been envisaged. For example, after the needle 5 has been pulled through the hole 6, the end 3 can also be pulled completely through the hole 6 so that a knot can be tied therein. The end 11 of the tail 6 is then pulled resulting in the knot becoming embedded in the hole 6.

Similarly, any suitable object can be attached to the end 3 of the tail 2 to assist in fixing the end 3 of the tail 2 within the hole 6.

Lastly, the end 2 of the tail 3 could be placed in a molding machine and a rubber ball 1 molded therearound. While these alternative methods seem feasible, they are not as simple and inexpensive as the mechanical interface depicted in FIG. 2.

While the present invention has been described in detail, it is to be understood that the ball with tail toy is not limited in scope by this description and an artisan of ordinary skill could remain within the spirit of the invention by modifying the invention so long as remaining within the scope of the following claims.

What is claimed is:

1. A toy comprising:

an elastomer ball having a hole therethrough; and a flexible tail member having a first end and a second end, said first end of said flexible tail member being inserted into said hole such that a portion of said tail member adjacent said first end comprises a U-shaped portion within said hole, a bottom of said U-shaped portion being substantially flush with an outer forward surface of said ball, and said second end of said tail member extends from said elastomer ball.

2. The toy of claim 1, wherein said ball comprises a material selected from the group consisting of rubbers and plastics.

3. The toy of claim 1, wherein said flexible tail comprises a material selected from the group consisting of nylon, nylon blends and stocking-like materials, such that said material will stretch to at least 1.25 times it normal size along its length.

4. The toy of claim 1, wherein a knot is provided adjacent said second end of said tail.

5. The toy of claim 1, wherein said first end of said tail comprises a first end of said U-shaped portion.

6. The toy of claim 5, wherein said first end of said tail is substantially flush with an outer rearward surface of said ball.

7. The toy of claim 1, wherein said hole corresponds to a diameter through said ball.

8. The toy of claim 1, wherein said tail member frictionally engages said elastomer ball within said hole.

9. A toy comprising:

an elastomer ball having a forward outer surface and a rearward outer surface, said elastomer ball having a diametrical hole therethrough; and a flexible tail member having a first end and a second end, said flexible tail member being inserted into said diametrical hole and frictionally engaging therewith such that said tail member comprises a U-shaped portion within said hole, said first end of said tail being substantially flush with said rearward outer surface of said ball and being a first end of said U-shaped portion, with a bottom portion of said U-shaped portion being substantially flush with said forward outer surface of said ball, and said second end of said tail extends outwardly from said diametrical hole from said rearward outer surface of said ball.

10. The toy of claim 9, wherein said elastomer ball comprises a material selected from the group consisting of rubbers and plastics.

11. The toy of claim 9, wherein said flexible tail comprises a material selected from the group consisting of nylon, nylon blends and stocking-like materials, such that said material will stretch to at least 1.25 times its normal size along its length.

12. The toy of claim 9, wherein a knot is provided adjacent said second end of said tail.

13. A toy comprising:

an elastomer ball having a forward outer surface and a rearward outer surface, said elastomer ball comprising a material selected from the group consisting of rubbers and plastics, and said elastomer ball having a diametrical hole therethrough; and a flexible tail member comprising a tail material selected from the group consisting of, nylon nylon blends, and stocking-like materials such that said tail material will stretch to at least 1.25 times its normal size along its length, said tail having a first end and a second end, said tail being inserted into said diametrical hole and frictionally engaging therewith such that said tail member comprises a U-shaped portion within said hole, said first end of said tail being substantially flush with said rearward outer surface of said ball and being a first end of said U-shaped portion, with a bottom portion of said U-shaped portion being substantially flush with said forward outer surface of said ball, and said second end of said tail extends outwardly from said diametrical hole from said rearward outer surface of said ball.

14. The toy of claim 13, wherein a knot is provided adjacent said second end of said tail.

* * * * *